US009447650B2

(12) United States Patent
Haun

(10) Patent No.: US 9,447,650 B2
(45) Date of Patent: Sep. 20, 2016

(54) SYSTEMS AND METHODS OF SUPPORTING A MULTILATERAL WINDOW

(71) Applicant: Halliburton Energy Services, Inc., Houston, TX (US)

(72) Inventor: Matthew Ryan Haun, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 206 days.

(21) Appl. No.: 14/118,624

(22) PCT Filed: Jan. 18, 2013

(86) PCT No.: PCT/US2013/022065

§ 371 (c)(1),
(2) Date: Nov. 19, 2013

(87) PCT Pub. No.: WO2014/113012

PCT Pub. Date: Jul. 24, 2014

(65) Prior Publication Data

US 2015/0152703 A1 Jun. 4, 2015

(51) Int. Cl.

| | |
|---|---|
| ***E21B 29/06*** | (2006.01) |
| ***E21B 7/08*** | (2006.01) |
| ***E21B 7/06*** | (2006.01) |
| ***E21B 17/00*** | (2006.01) |

(52) U.S. Cl.

CPC ..... *E21B 29/06* (2013.01); *E21B 7/061* (2013.01); *E21B 17/00* (2013.01)

(58) Field of Classification Search

CPC ..... E21B 29/06; E21B 7/061; E21B 7/062; E21B 17/00

See application file for complete search history.

(56) References Cited

U.S. PATENT DOCUMENTS

| | | | | | |
|---|---|---|---|---|---|
| 1,615,037 | A * | 1/1927 | Raymond | E21B 7/061 | 166/117.5 |
| 2,211,803 | A * | 8/1940 | Warburton | E21B 7/061 | 144/242.1 |
| 2,694,549 | A * | 11/1954 | James | E21B 7/061 | 175/323 |
| 3,398,804 | A * | 8/1968 | Holbert | E21B 7/061 | 175/61 |
| 4,397,360 | A * | 8/1983 | Schmidt | E21B 7/061 | 175/61 |
| 5,474,126 | A * | 12/1995 | Lynde | E21B 29/06 | 166/117.6 |
| 5,501,281 | A | 3/1996 | White et al. | | |

(Continued)

FOREIGN PATENT DOCUMENTS

WO 2014113012 A1 7/2014

OTHER PUBLICATIONS

Sleeve. (n.d.). Dictionary.com Unabridged. Retrieved Sep. 29, 2015, from Dictionary.com website: http://dictionary.reference.com/browse/sleeve.*

(Continued)

*Primary Examiner* — Robert E Fuller

(74) *Attorney, Agent, or Firm* — McDermott Will & Emery LLP; Scott Richardson

(57) ABSTRACT

A milling system includes an elongate body having a first end, a second end, and a mill window defined through a portion of the body between the first and second ends. A mill is movably arranged within the body, and a whipstock assembly is arranged at least partially within the body and configured to guide the mill out of the body through the mill window in order to mill a casing exit. A torque sleeve is coupled to the body and extends over a portion of the body between the first and second ends so as to increase a torsional resistance of the body.

19 Claims, 4 Drawing Sheets

(56) References Cited

U.S. PATENT DOCUMENTS

| | | | | |
|---|---|---|---|---|
| 5,615,740 | A | 4/1997 | Comeau et al. | |
| 5,778,980 | A | 7/1998 | Comeau et al. | |
| 5,787,978 | A * | 8/1998 | Carter | E21B 7/061 166/117.6 |
| 5,884,698 | A * | 3/1999 | Hughes | E21B 7/061 166/117.6 |
| 6,041,855 | A | 3/2000 | Nistor | |
| 6,868,909 | B2 * | 3/2005 | Murray | E21B 29/06 166/117.5 |
| 7,104,332 | B2 | 9/2006 | Murray et al. | |
| 8,602,097 | B2 * | 12/2013 | Hepburn | E21B 41/0035 166/117.5 |
| 2010/0147592 | A1 | 6/2010 | Hearn et al. | |
| 2011/0240283 | A1 * | 10/2011 | Steele | E21B 29/06 166/169 |

OTHER PUBLICATIONS

International Search Report and Written Opinion for PCT/US2013/022065 filed Oct. 4, 2013.

* cited by examiner

SYSTEMS AND METHODS OF SUPPORTING A MULTILATERAL WINDOW

CROSS REFERENCE TO RELATED APPLICATIONS

This application is a National Stage entry of and claims priority to International Application No. PCT/US2013/022065, filed on Jan. 18, 2013.

BACKGROUND

The present invention relates to equipment used in subterranean operations and, in particular, to systems and methods for providing torque support to a multilateral window milling system.

Hydrocarbons can be produced through relatively complex wellbores traversing one or more subterranean formations. Some wellbores can include multilateral wellbores and/or sidetrack wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first general direction and a secondary wellbore diverted from the main wellbore in a second general direction. A multilateral wellbore can include one or more windows or casing exits to allow corresponding lateral wellbores to be formed. A sidetrack wellbore can also include a window or casing exit to allow the wellbore to be diverted to the second general direction.

The casing exit for either a multilateral or a sidetrack wellbore can be formed by positioning a casing joint and a whipstock in a casing string at a desired location in the main wellbore. The whipstock is used to deflect one or more mills laterally (or in an alternative orientation) relative to the casing string. The deflected mill(s) penetrates part of the casing joint to form the casing exit in the casing string. Drill bits can be subsequently inserted through the casing exit in order to cut the lateral or secondary wellbore.

The mill(s) used to create the casing exit are part of a milling system that is generally conveyed to the location of the lateral or secondary wellbore with drill string or work string. In extended reach well applications, the torque at the surface is not necessarily the same as the torque experienced downhole by the milling system. As a result, the milling system can experience high torque loads while trying to orient, anchor, locate, retrieve, get unstuck, or maneuver the milling system within the wellbore. Such milling systems are limited in torque transmission because they are typically supported only on one side and, as a result, promote uneven loading and twisting on accompanying milling guide tracks which can lead to failure in milling operations. More robust milling systems are therefore needed.

SUMMARY OF THE INVENTION

The present invention relates to equipment used in subterranean operations and, in particular, to systems and methods for providing torque support to a multilateral window milling system.

In some embodiments, a milling system is disclosed. The milling system may an elongate body having a first end, a second end, and a mill window defined through a portion of the body between the first and second ends, a mill movably arranged within the body, a whipstock assembly arranged at least partially within the body and configured to guide the mill out of the body through the mill window in order to mill a casing exit, and a torque sleeve coupled to the body and extending over a portion of the body between the first and second ends so as to increase a torsional resistance of the body.

In other embodiments, a method of reinforcing a milling system is disclosed. The method may include providing an elongate body having a first end and a second end and a whipstock assembly arranged between the first and second ends, the whipstock assembly defining a mill window through the body, and coupling a torque sleeve to the body, the torque sleeve extending between the first and second ends and generally occluding the mill window to increase a torsional resistance of the body.

In yet other embodiments, a method of milling a casing exit in a casing string that lines a wellbore is disclosed. The method may include conveying a milling system into the wellbore, the milling system comprising an elongate body having a first end and a second end and a mill movably arranged therein, the body further defining a mill window, reinforcing the milling system against torsional loading with a torque sleeve coupled to the body, the torque sleeve extending between the first and second ends and generally occluding the mill window, advancing the mill within the body and deflecting the mill into contact with the torque sleeve with a whipstock assembly arranged between the first and second ends, milling through the torque sleeve with the mill, and exiting the body to mill the casing exit with the mill.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present invention relates to equipment used in subterranean operations and, in particular, to systems and methods for providing torque support to a multilateral window milling system.

The systems and methods disclosed herein provide a more robust milling system that may be able to resist increased torsional loading experienced when trying to orient, anchor, locate, retrieve, get unstuck, or maneuver the milling system downhole. In at least one embodiment, a millable torque sleeve may be coupled to the milling system and may fully wrap the whipstock or guide support, which normally is limited in rotational loading since it is only supported from the track side. Fully supporting the guide support may help alleviate uneven twisting loads that are experienced by the milling system when trying to torque through downhole obstructions or anchor the milling system for operation. Moreover, the ability to easily mill through the torque sleeve may nonetheless allow the milling system to efficiently mill a casing exit as intended. The disclosed systems and methods may be particularly advantageous for use in extended reach wells, or difficult wells in general, where torque at the surface is not necessarily the same as the torque seen downhole by the milling system.

Figure 1:
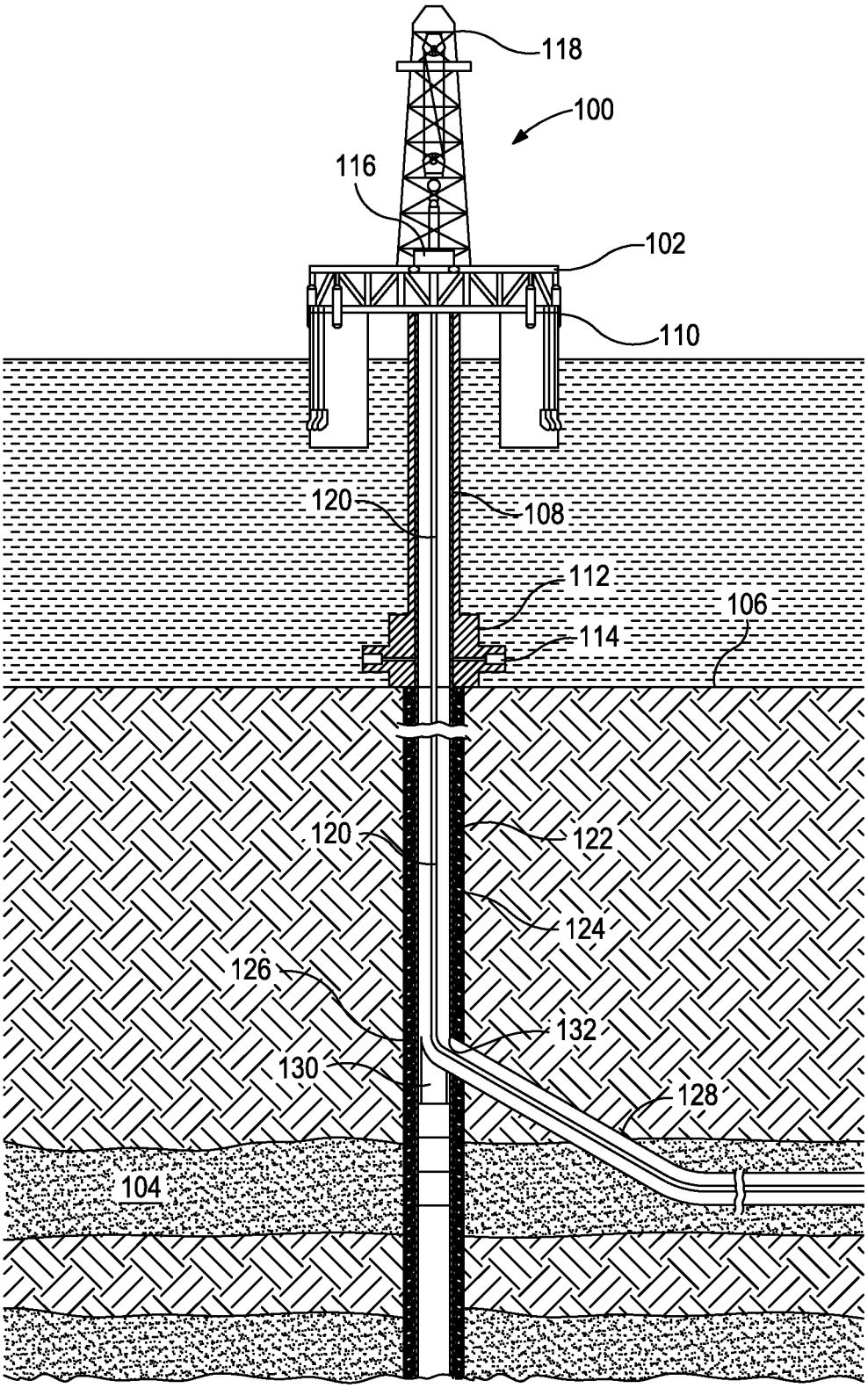
FIG. 1 illustrates an offshore oil and gas platform that may employ milling system to create a casing exit, according to one or more embodiments disclosed.

Referring to FIG. 1, illustrated is an offshore oil and gas platform 100 that may employ an exemplary milling system as described herein, according to one or more embodiments. Even though FIG. 1 depicts an offshore oil and gas platform 100, it will be appreciated by those skilled in the art that the various embodiments discussed herein are equally well suited for use in conjunction with other types of oil and gas rigs, such as land-based oil and gas rigs or rigs located at any other geographical site. In the illustrated embodiment, however, the platform 100 may be a semi-submersible platform 102 centered over a submerged oil and gas formation 104 located below the sea floor 106. A subsea riser or conduit 108 extends from the deck 110 of the platform 102 to a wellhead installation 112 arranged on the sea floor 106 and including one or more blowout preventers 114. The platform 102 has a hoisting apparatus 116 and a derrick 118 for raising and lowering pipe strings, such as a drill string 120, within the subsea conduit 108.

As depicted, a main wellbore 122 has been drilled through the various earth strata, including the formation 104. The terms "parent" and "main" wellbore are used herein interchangeably to designate a wellbore from which another wellbore is drilled. It is to be noted, however, that a parent or main wellbore does not necessarily extend directly to the earth's surface, but could instead be a branch of another wellbore. A casing string 124 is at least partially cemented within the main wellbore 122. The term "casing" is used herein to designate a tubular string used to line a wellbore. In some applications, the casing may be of the type known to those skilled in the art as "liner" and may be a segmented liner or a continuous liner, such as coiled tubing.

A casing joint 126 may be interconnected between elongate portions or lengths of the casing string 124 and positioned at a desired location within the wellbore 122 where a branch or lateral wellbore 128 is to be drilled. Accordingly, the casing joint 126 effectively forms an integral part of the casing string 124. The terms "branch" and "lateral" wellbore are used herein to designate a wellbore which is drilled outwardly from its intersection or junction with another wellbore, such as the parent or main wellbore 122. Moreover, a branch or lateral wellbore may have another branch or lateral wellbore drilled outwardly therefrom, without departing from the scope of the disclosure. A whipstock assembly 130, or another type of mill guide known to those skilled in the art, may be positioned within the casing string 124 and/or the casing joint 126. The whipstock assembly 130 may be configured to deflect one or more cutting tools (i.e., mills) into the inner wall of the casing joint 126 such that a casing exit 132 is defined therein at a desired circumferential location. The casing exit 132 provides a "window" in the casing joint 126 through which one or more other cutting tools (i.e., drill bits) may be inserted in order to drill the lateral wellbore 128.

It will be appreciated by those skilled in the art that even though FIG. 1 depicts a vertical section of the main wellbore 122, the embodiments described herein are equally applicable for use in wellbores having other directional configurations including horizontal wellbores, deviated wellbores, slanted wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
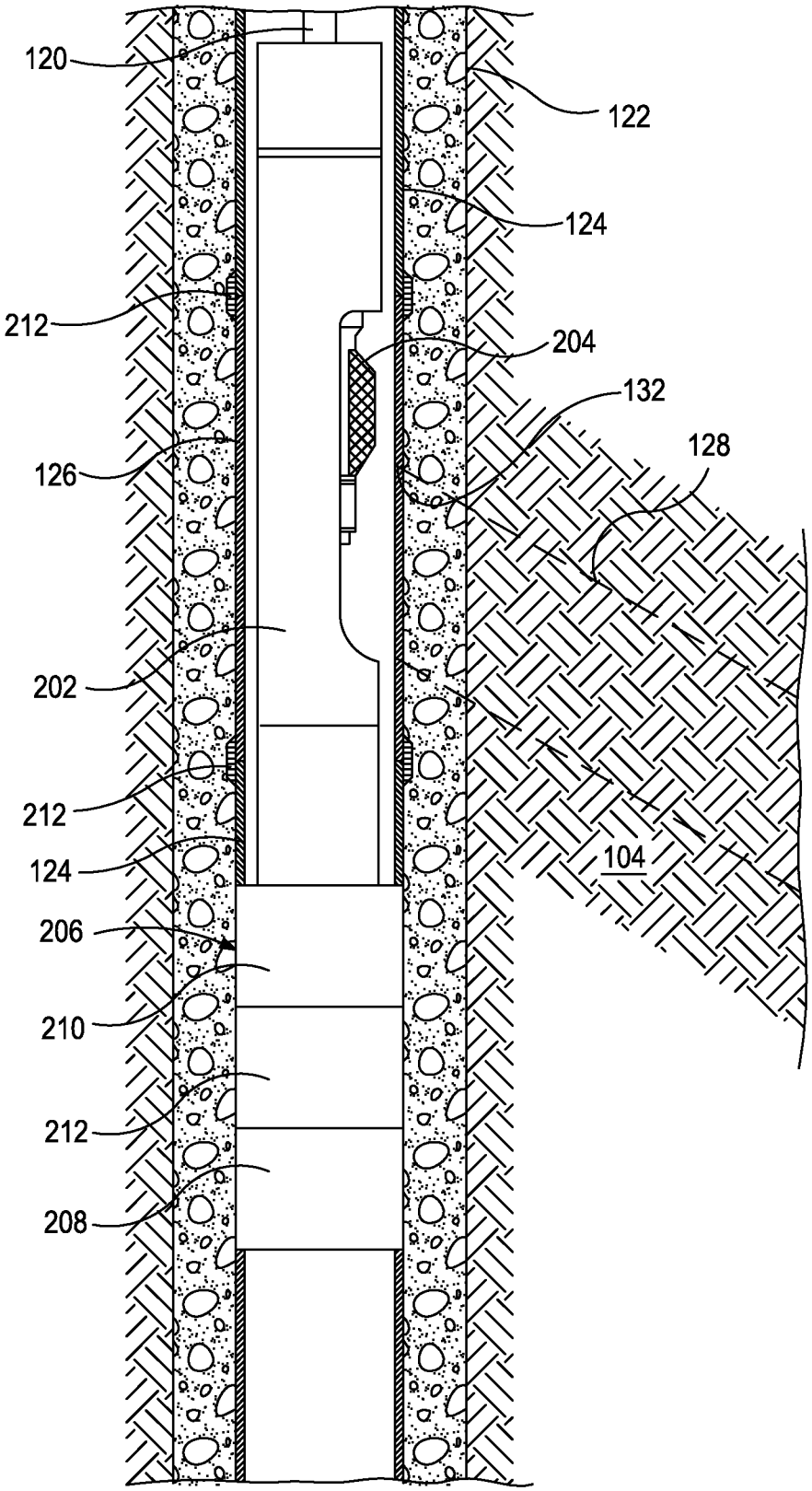
FIG. 2 illustrates an enlarged view of the junction between the parent wellbore and a drilled lateral wellbore.

Referring now to FIG. 2, with continued reference to FIG. 1, illustrated is an enlarged view of the junction between the main wellbore 122 and the lateral wellbore 128 (shown in dashed) before the lateral wellbore 128 is drilled or otherwise formed in the surrounding subterranean formation 104. In order to commence drilling of the lateral wellbore 128, a milling system 202 may be coupled to the drill string 120 (or any other type of work string) and conveyed through the wellbore 122 to the location where the lateral wellbore 128 is to be drilled. The milling system 202 may include at least one mill 204 configured to be brought into contact with the casing string 124 in order to mill the casing exit 132 therein. As will be discussed in greater detail below, this may be accomplished by redirecting the axial movement of the mill 204 using the whipstock assembly 130 (FIG. 1) or another type of mill guide system.

In at least one embodiment, the milling system 202 may be the First Pass MILLRITE® system, commercially available from Halliburton Energy Services of Houston, Tex., USA. In other embodiments, however, the milling system 202 may be any multilateral milling system known to those skilled in the art. For example, the milling system 202 may be any milling system that is able to mill a casing exit 132 in the casing string 124 and subsequently facilitate drilling into the surrounding subterranean formation 104 to form the lateral wellbore 128. It should be noted that the milling system 202 as depicted in FIG. 2 is not necessarily drawn to scale but is shown for illustrative purposes in describing features of the disclosure in conjunction with the lateral wellbore 128 and casing exit 132.

Once reaching the location where the lateral wellbore 128 is to be drilled, the milling system 202 may be configured to engage an anchor latch 206 arranged within the casing string 124. The anchor latch 206 may include various tools and tubular lengths interconnected in order to rotate and align the milling system 202 (both radially and axially) to the correct exit angle orientation and axial well depth in preparation for milling the casing exit 132. In some embodiments, the anchor latch 206 may be a Sperry multilateral latch or coupling system available from Halliburton Energy Services of Houston, Tex., USA. In other embodiments, the anchor latch 206 may be a muleshoe orienting guide with a no-go and shear latch combination, or any other mechanical means used to locate the milling system 202 both on depth within the main wellbore 122 and at the correct exit angle orientation for forming the casing exit 132.

In one or more embodiments, the anchor latch 206 may include a latch coupling 208 having a profile and a plurality of circumferential alignment elements operable to receive a corresponding latch mechanism or assembly 306 (FIGS. 3A and 4A) of the milling system 202 and thereby locate the latch assembly 306 in a predetermined circumferential orientation. The anchor latch 206 may further include an alignment bushing 210 having a longitudinal slot that is circumferentially referenced to the circumferential alignment elements of the latch coupling 208. Positioned between the latch coupling 208 and the alignment bushing 210 may be a casing alignment sub 212 that may be used to ensure proper alignment of the latch coupling 208 relative to the alignment bushing 210. It will be understood by those skilled in the art that the anchor latch 206 may include a greater or lesser number of tools or a different set of tools that are operable to enable a determination of an offset angle between a circumferential reference element and a desired circumferential orientation of the casing exit 132.

Figure 3A:
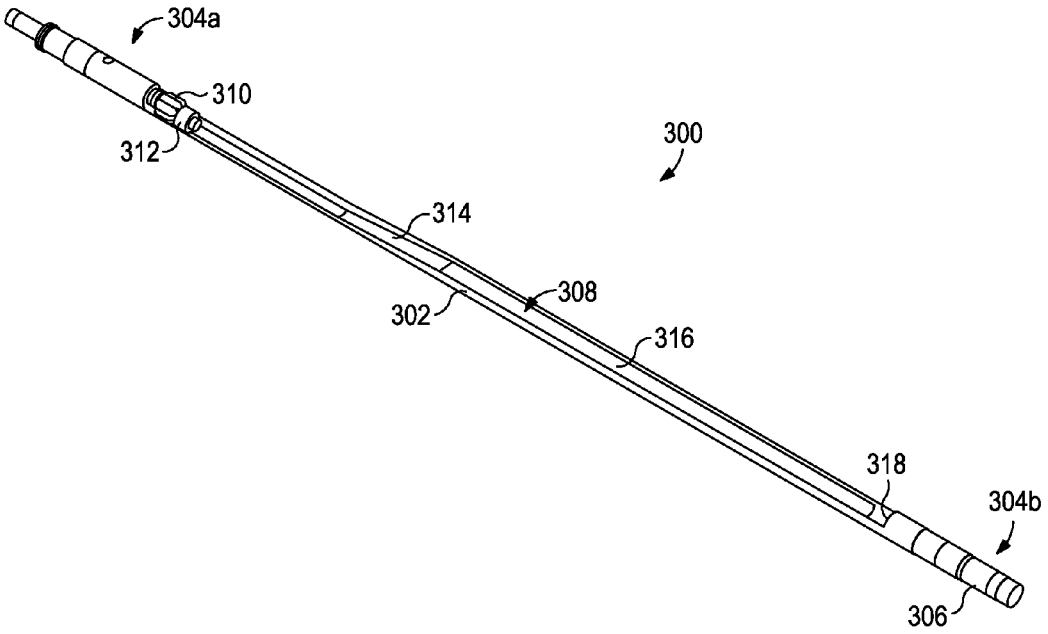
FIGS. 3A and 3B illustrate isometric and partial side views, respectively, an exemplary milling system, according to one or more embodiments.
Figure 3B:
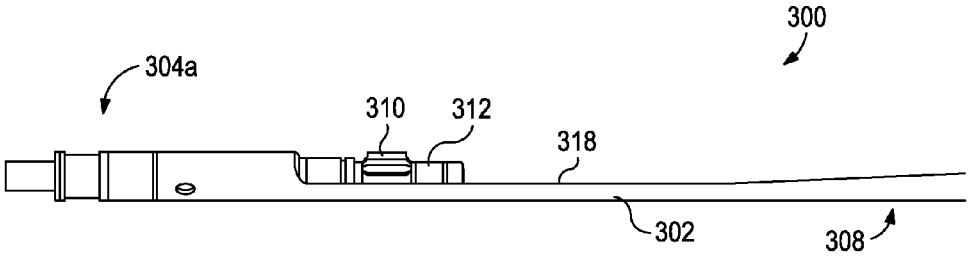

Referring now to FIGS. 3A and 3B, with continued reference to FIG. 2, illustrated are isometric and partial side views, respectively, of an exemplary milling system 300, according to one or more embodiments. The milling system 300 may be similar in some respects to the milling system 202 of FIG. 2, and therefore may be used to help create the casing exit 132 (FIG. 2) in the casing string 124 (FIG. 2). As illustrated, the milling system 300 may include an elongate body 302 having a first end 304*a* and a second end 304*b* (not shown in FIG. 3B). The first end 304*a* may be coupled or otherwise attached to the drill string 120 (FIG. 2) which conveys the milling system 300 into the wellbore 122 (FIG. 2). The second end 304*b* may include a latch assembly 306 configured to locate and connect to the anchor latch 206 (FIG. 2), as will be described in more detail below.

As depicted in FIG. 3A, the milling system 300 may further include a whipstock assembly 308 that either forms an integral part of the body 302 or is otherwise coupled or attached thereto. The whipstock assembly 308, also commonly referred to as a "guide support," may be a generally arcuate and elongate member that supports and guides a mill 310 as it moves axially downhole to mill the casing exit 132 (FIG. 2). In some embodiments, the mill 310 may be similar to the mill 204 of FIG. 2. The whipstock assembly 308 may be configured to guide the mill 310 into milling engagement with the casing string 124 (FIG. 2) and subsequently maintain the mill 310 in a substantially straight line with respect to the main wellbore 122 (FIG. 2) as the mill 310 continues its axial movement.

The mill 310 may include a guide block 312 (also known as a "traveling guide block" or a "mill block") which may generally support and guide the mill 310 within the whipstock assembly 308. As illustrated, the whipstock assembly 308 may define or otherwise form a ramp portion 314 that transitions into a planar portion 316. As the mill 310 advances downhole, the guide block 312 translates axially along the ramp portion 314 which gradually urges the rotating mill 310 into contact with the inner surface of the casing string 124, thereby initiating the formation of the casing exit 132 (FIG. 2). As the mill 310 continues advancing downhole, the guide block 312 moves along the planar portion 316 of the whipstock assembly 308 and the axial length or opening of the casing exit 132 (FIG. 2) is correspondingly extended. Further description of the whipstock assembly 308 and its interaction with the mill 310 and the guide block 312 may be found in U.S. Pat. No. 5,778,980, entitled "Multicut Casing Window Mill and Method for Forming a Casing Window," the contents of which are hereby incorporated by reference in their entirety.

The body 302 of the milling assembly 300 may further define a mill opening or window 318 which may allow the mill 310 to extend radially out of the body 302 and into contact with the casing string 124 (FIG. 2) in order to mill the casing exit 132 (FIG. 2). While the mill window 318 facilitates an unobstructed exit for the mill 310 from the elongate body 302, the mill window 318 may simultaneously impart an amount axial weakness to the body 302 or the whipstock assembly 308. For instance, the body 302 of the milling assembly 300 that corresponds to the whipstock assembly 308 may be axially and radially supported on only one side thereof, while the opposing side is open in order to provide the mill window 318. Accordingly, the body 302 may be weaker along its axial length where the mill window 318 is defined.

The milling system 300 may experience torsional or rotational loading when attempting to orient, anchor, locate, retrieve, get unstuck, or otherwise maneuver the milling system 300 within the wellbore 122. For instance, increased torque loads can be present when attempting to anchor the milling system 300 at the anchor latch 206 (FIG. 2). Such a process may include locating the anchor latch 206 with the latch assembly 306 and applying an axial load to the milling system 300 through the drill string 120 such that the latch assembly 306 is properly inserted into the anchor latch 206. The milling system 300 may then be retracted and simultaneously rotated in order to appropriately engage the latch assembly 306 to the anchor latch 206. In some applications, such rotational force applied to the milling system 300 may overtorque the body 302 and result in uneven twisting loads that may result in the plastic deformation of the body 302 and/or the whipstock assembly 308. If the whipstock assembly 308 becomes deformed, the mill 310 may become stuck or wedged, or the casing exit 132 may be improperly milled or located.

According to one or more embodiments, the risk of torsion failure to the body 302 and/or the whipstock assembly 308 may be reduced by reinforcing the body 302 such that it is better able to sustain torque loading as applied to the milling system 300 through the drill string 120 (FIG. 2). Such reinforcing may be best employed along the portions of the body 302 most susceptible to yielding in the face of torsional loading, such as where the mill window 318 is defined.

Figure 4A:
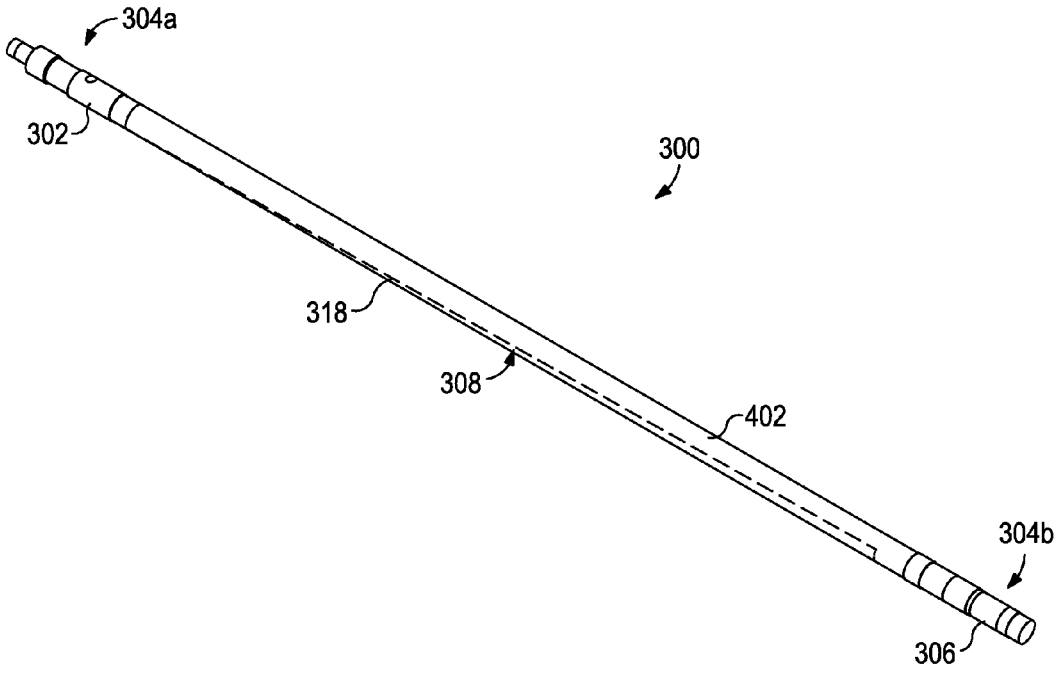
FIGS. 4A and 4B illustrate isometric and partial side views of the milling system of FIGS. 3A and 3B, respectively, including an exemplary torque sleeve coupled thereto, according one or more embodiments.
Figure 4B:
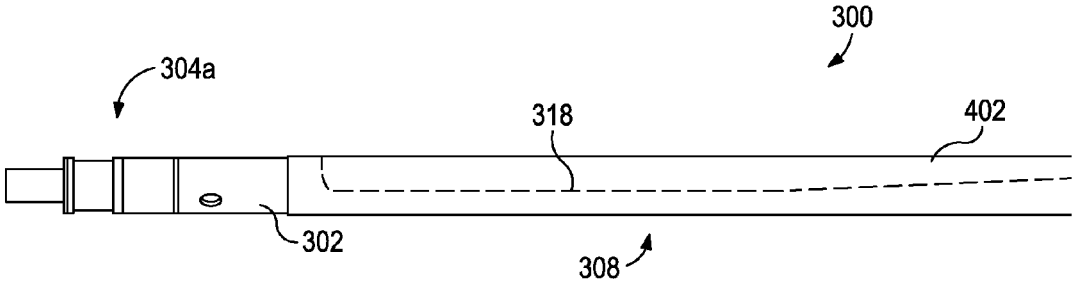

Referring now to FIGS. 4A and 4B, with continued reference to FIGS. 2 and 3A-3B, illustrated are isometric and partial side views of the milling system 300, respectively, including an exemplary torque sleeve 402 coupled thereto, according to at least one embodiment. The torque sleeve 402 may be coupled to the milling system 300 in order to provide a reinforcing high torque support member. As illustrated, in at least one embodiment the torque sleeve 402 may be configured to axially and circumferentially encase the whipstock assembly 308, including generally occluding the mill window 318 which may at least partially contribute to the axial weakness of the body 302. In operation, the torque sleeve 402 may be configured to allow torque to be applied through the milling system 300, such as when maneuvering the milling system 300 within in the wellbore 122, but simultaneously serve to reduce the risk of torsion failure to the body 302 and/or the whipstock assembly 308.

The torque sleeve 402 may be a generally elongate and cylindrical member that extends along the axial length of the body 302. In other embodiments, the torque sleeve 402 may be an arcuate member, but not necessarily designed to extend all the way around the body 302, but instead may be characterized as a cylindrical trough. The torque sleeve 402 may be coupled or otherwise attached to the body 302. In some embodiments, for example, the torque sleeve 402 may be coupled to the body by attaching at both the first end 304*a* and the second end 304*b*. In other embodiments, however, the torque sleeve 402 may be coupled to the body 302 at any intermediate point(s) between the first and second ends 304*a,b*, without departing from the scope of the disclosure. The torque sleeve 402 may be coupled to the body 302 using mechanical fasteners, such as set screws, bolts, or the like. In other embodiments, the torque sleeve 402 may be coupled at each end 304*a,b* using a variety of other mechanical fastening techniques including, but not limited to, threading, welding or brazing, adhesives, snap rings, castellations, magnetic coupling arrangements, friction fittings, interference fittings, combinations thereof, or the like.

In one or more embodiments, the torque sleeve 402 may be made of a material that is generally millable by the mill 310. Accordingly, the torque sleeve 402 may not adversely affect any operating features of the milling machine 300, but may instead allow for the efficient milling of the casing exit 132 (FIG. 2) while simultaneously serving to increase the torque resistance of the body 302. In some embodiments, the torque sleeve 402 may be made of aluminum or any aluminum alloy. In other embodiments, the torque sleeve 402 may be made of any soft, millable material including, but not limited to, copper, copper alloys, low carbon steel, resins, plastics, polymers, fabric reinforced polymer, carbon fiber, reinforced carbon fiber, fiberglass, composite materials, any lightweight/low density material, combinations thereof, and the like.

While being made of a softer and generally millable material, the torque sleeve 402 may nonetheless serve to reinforce the body 302 against the onset of high torque loads that may be experienced when attempting to orient, anchor, locate, retrieve, get unstuck, or otherwise maneuver the milling system 300 within the wellbore 122. This may prove especially advantageous in extended reach wellbores, where the torque that is applied at the surface may not be the same torque that is experienced by the milling system 300. In such extended reach applications, the milling system 300 may be inadvertently overtorqued and permanently damaged unless properly reinforced for high torque loads. The torque sleeve 402 may provide such a reinforcement by helping the milling system 300 sustain increased torque loads before yielding and otherwise twisting into plastic deformation. Such increased resistance against torque loading may prove advantageous, for example, in attempting to couple the latch assembly 306 to the anchor latch 206 (FIG. 2), where significant amounts of torsion may be applied through the drill string 120 in order to properly connect the milling system 300.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A milling system, comprising:

an elongate body having a first end, a second end, and an unobstructed mill window defined through a portion of the body between the first and second ends;

a mill positioned within the body;

a whipstock assembly arranged at least partially within the body and aligned with the mill window to guide the mill out of the body through the mill window to mill a casing exit through radially adjacent casing; and a torque sleeve coupled to an exterior of the body and extending over a portion of the body between the first and second ends to occlude at least a portion of the mill window and thereby increase a torsional resistance of the body.

2. The milling system of claim 1, wherein the torque sleeve axially and circumferentially encases at least a portion of the whipstock assembly.

3. The milling system of claim 1, wherein the torque sleeve comprises an arcuate member extending only partially around a circumference of the body.

4. The milling system of claim 1, wherein the torque sleeve is coupled to the body at the first and second ends.

5. The milling system of claim 1, wherein the torque sleeve is mechanically attached to the body using at least one of mechanical fasteners, threading, welding or brazing, adhesives, snap rings, castellations, magnetic coupling arrangements, friction fittings, interference fittings, and combinations thereof.

6. The milling system of claim 1, wherein the torque sleeve is made of a millable material selected from the group consisting of aluminum, aluminum alloys, copper, copper alloys, low carbon steel, resins, plastics, polymers, fabric reinforced polymer, carbon fiber, reinforced carbon fiber, fiberglass, composite materials, a lightweight/low density material, and combinations thereof.

7. A method of reinforcing a milling system, comprising:

providing an elongate body having a first end, a second end, and a whipstock assembly secured within an interior of the body and arranged between the first and second ends, wherein a mill window is defined through a portion of the body between the first and second ends; and coupling a torque sleeve to an exterior of the body, the torque sleeve extending over a portion of the body between the first and second ends and occluding an unobstructed portion of the mill window to increase a torsional resistance of the body.

8. The method of claim 7, wherein coupling the torque sleeve to the body further comprises mechanically attaching the torque sleeve to the first and second ends using at least one of mechanical fasteners, threading, welding or brazing, adhesives, snap rings, castellations, magnetic coupling arrangements, friction fittings, interference fittings, and combinations thereof.

9. The method of claim 7, wherein coupling the torque sleeve to the body further comprises mechanically attaching the torque sleeve to the body using at least one of mechanical fasteners, threading, welding or brazing, adhesives, snap rings, castellations, magnetic coupling arrangements, friction fittings, interference fittings, and combinations thereof.

10. The method of claim 7, wherein coupling the torque sleeve to the body further comprises encasing at least a portion of the whipstock assembly both axially and circumferentially.

11. The method of claim 7, wherein coupling the torque sleeve to the body further comprises entirely occluding the mill window with the torque sleeve.

12. The method of claim 7, wherein the torque sleeve is made of a millable material selected from the group comprising aluminum, aluminum alloys, copper, copper alloys, low carbon steel, resins, plastics, polymers, fabric reinforced polymer, carbon fiber, reinforced carbon fiber, fiberglass, composite materials, a lightweight/low density material, and combinations thereof.

13. A method of milling a casing exit in casing that lines a wellbore, comprising:

conveying a milling system into the wellbore, the milling system comprising an elongate body having a first end, a second end, and a mill positioned within the body, wherein a mill window is defined through a portion of the body between the first and second ends;

mitigating torsional loading of the body with a torque sleeve coupled to an exterior of the body, the torque sleeve extending over a portion of the body between the first and second ends and occluding an unobstructed portion of the mill window;

advancing the mill within the body and deflecting the mill into contact with the torque sleeve with a whipstock assembly;

milling through the torque sleeve with the mill and exiting the body; and milling the casing exit through the casing with the mill.

14. The method of claim 13, wherein reinforcing the milling system against torsional loading with the torque sleeve further comprises mechanically attaching the torque sleeve to the first and second ends of the body using at least one of mechanical fasteners, threading, welding or brazing, adhesives, snap rings, castellations, magnetic coupling arrangements, friction fittings, interference fittings, and combinations thereof.

15. The method of claim 13, wherein reinforcing the milling system against torsional loading with the torque sleeve further comprises mechanically attaching the torque sleeve to the body using at least one of mechanical fasteners, threading, welding or brazing, adhesives, snap rings, castellations, magnetic coupling arrangements, friction fittings, interference fittings, and combinations thereof.

16. The method of claim 13, further comprising encasing at least a portion of the whipstock assembly both axially and circumferentially with the torque sleeve.

17. The method of claim 13, further comprising entirely occluding the mill window with the torque sleeve.

18. The method of claim 13, wherein milling through the torque sleeve further comprises milling through a millable material selected from the group comprising aluminum, aluminum alloys, copper, copper alloys, low carbon steel, resins, plastics, polymers, fabric reinforced polymer, carbon fiber, reinforced carbon fiber, fiberglass, composite materials, any lightweight/low density material, and combinations thereof.

19. The method of claim 13, wherein mitigating the torsional loading of the body comprises:

applying a torque load to the milling system through a drill string coupled to the first end to maneuver the milling system within the wellbore; and resisting the torque load with the torque sleeve, and thereby preventing overtorque of the milling system.

* * * * *